US005454512A

United States Patent [19]

Berlaimont et al.

[11] Patent Number: 5,454,512

[45] Date of Patent: Oct. 3, 1995

[54] HEAT SOURCE COVER

[75] Inventors: Claude Berlaimont, Falisolle; Raymond Champion, Couvin, both of Belgium

[73] Assignee: Nestor Martin S.A., Brussels, Belgium

[21] Appl. No.: 162,150

[22] PCT Filed: Apr. 13, 1993

[86] PCT No.: PCT/BE93/00018

§ 371 Date: Jan. 3, 1994

§ 102(e) Date: Jan. 3, 1994

[87] PCT Pub. No.: WO93/21481

PCT Pub. Date: Oct. 28, 1993

[30] Foreign Application Priority Data

Apr. 13, 1992 [BE] Belgium ..... 9200327

[51] Int. Cl.[6] ..... F24D 19/06

[52] U.S. Cl. ..... 237/79; 165/135

[58] Field of Search ..... 237/79; 165/135, 165/904

[56] References Cited

U.S. PATENT DOCUMENTS

| | | | |
|---|---|---|---|
| 1,892,954 | 1/1933 | Kauffman | 237/79 |
| 2,476,432 | 7/1949 | Sawyer | 237/79 |
| 2,865,569 | 12/1958 | Levenberg | 237/79 |
| 3,090,212 | 5/1963 | Anderson et al. | 165/904 X |
| 3,315,846 | 4/1967 | Landis et al. | 165/135 X |
| 4,383,575 | 5/1983 | Bobrowski | 165/135 X |
| 5,307,849 | 5/1994 | Nelson | 237/79 X |

FOREIGN PATENT DOCUMENTS

| | | |
|---|---|---|
| 1778235 | 8/1971 | Germany . |
| 59-202337 | 11/1984 | Japan . |
| 85/00552 | 2/1985 | WIPO . |

*Primary Examiner*—William E. Tapolcai
*Attorney, Agent, or Firm*—Spencer, Frank & Schneider

[57] ABSTRACT

A cover for a heating body comprising a thin wall at least partially screening the heating body from a region outside of the heating body. The thin wall comprises a polymeric material being substantially rigid and substantially resisting permanent deformation at temperatures from 100° C. to 130° C., the polymeric material further substantially resisting infrared absorption at wavelengths corresponding to black-body temperatures of 200° C. to 500° C.

18 Claims, 2 Drawing Sheets

HEAT SOURCE COVER

FIELD OF THE INVENTION

The present invention relates to a cover for a heat source, in particular for a heating body, such as hot liquid containing tanks, radiators and the like, comprising a thin wall screening at least partially the heat source from the outside.

BACKGROUND OF THE INVENTION

These covers of this type are already known for a long time, in particular covers in enamelled, lacquered or chromium-plated plate or cast iron.

These covers involve technological problems with respect to their forming and colouring. Moreover, they are not transparent for infrared radiation emitted by the heating device when this device is for example a heating body, more particularly a domestic stove. After having covered the latter, the ambient atmosphere can only be heated by convection.

JP-A-59202337 discloses a protective grate which is to be placed on the radiation surface of a radiator, the grate being of polyester and having large openings for allowing the heat to pass therethrough.

SUMMARY OF THE INVENTION

An object of the present invention is to work out a cover as described hereinabove which avoids the aforesaid drawbacks while being not expensive and easy to manufacture. Advantageously, this cover will allow to increase the comfort of a heating body by allowing radiation heating.

In order to solve these problems, a cover as described hereinabove was provided, according to the invention, wherein said thin wall is based on a polymeric material having a high rigidity and a good deformation strength at a temperature above 100° C., and wherein the used polymeric material has a low infrared absorption at wavelengths corresponding to black-body temperatures of 200° C. to 500° C. Covered with such a cover, a heating body will be able to heat the ambient atmosphere not only by convection but also by radiation, which results in considerably higher energy savings and an improved impression of comfort. Advantageously, the used polymeric material shows these properties at a temperature above 130° C., preferably above 200° C.

By deformation strength it has to be understood that the wall from polymeric material resists to a permanent deformation. When a mechanic pressure is for example exerted onto this wall, it does not bend or possibly it may inflect in an elastical way while taking in afterwards its initial position again. At the indicated temperature, the wall is also not subject to flow.

The use of a non-metal material offers the big advantage of a simple and well known manufacture process, for example by moulding, thermoforming or by an analogous process. This allows also to stain the polymeric material in the mass with a colorant or a pigment and hence to omit the application of a coloured coating. Finally, a large freedom of design is achieved by such a cover from polymeric material, which is a non-negligible quality for such an element serving to mask another.

A cover of this type is moreover relatively light and easy to handle.

According to an embodiment of the invention, the plastic material is a polyester resin. Advantageously, the polyester resin is selected within the group comprising bisphenol A fumarates, isophthalic resins and chlorendic resins.

In a particularly advantageous way, the polymeric material is an oriented crystal polymer, for example a lyotropic liquid crystal polymer such as Kevlar, or a thermotropic liquid crystal polymer such as Rhodester CL. In this case, a cover resisting to temperatures of 350° C. might even be taken into consideration.

In a very particular embodiment of the invention, the thin wall is made of a composite material containing said polymeric material. In the composite material, the polymeric material may be reinforced with fibres, for example a.o. with glass fibres, carbon fibres, liquid crystal polymers. In certain applications, the composite material may also be composed of at least one possibly reinforced layer of said polymeric material and of at least one layer of another material supporting the previous layer.

Other particular embodiments of the invention are indicated in the claims.

Other details and particularities of the invention will become apparent from the description given hereinafter by way of non limiting examples with reference to the annexed drawings.

DETAILED DESCRIPTION OF THE PREFERRED EMBODIMENTS

Figure 1:
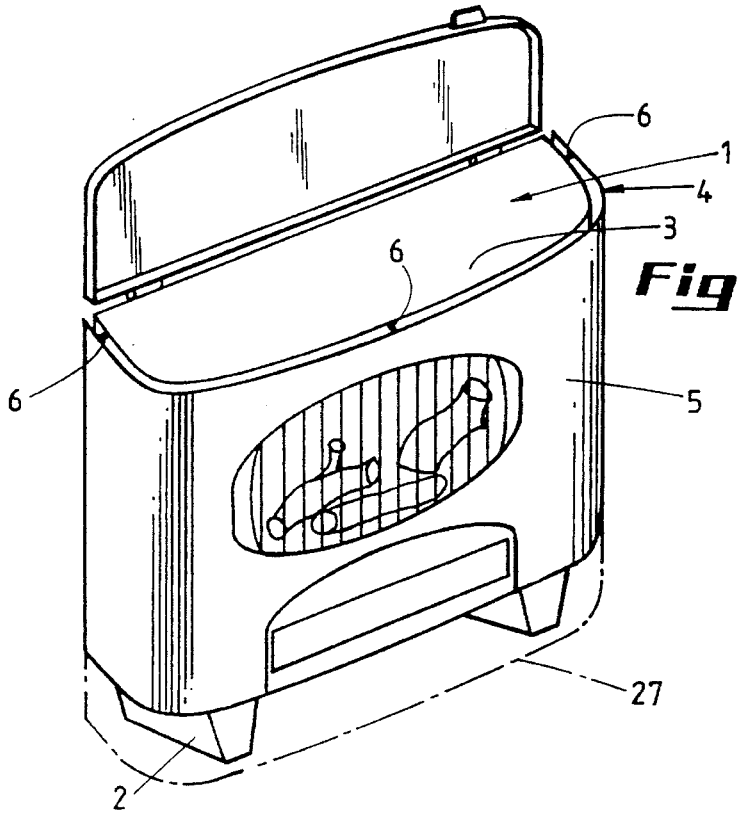
FIG. 1 shows a perspective view of a domestic wood stove equipped with a cover according to the invention.

In the different figures, identical or analogous elements have been given the same reference numerals.

FIG. 1 shows a usual wood stove 1 which rests onto two legs 2 supporting the heating body 3.

In front of the heating body a cover 4 according to the invention is placed which consists of a protective panel 5 supported by the heating body 3 through the intermediary of attachment elements 6, only three of which are shown schematically in FIG. 1. As further seen in FIG. 1, panel 5 may have a continuous surface.

The illustrated panel is made from a polyester resin selected preferably amongst bisphenol A fumarates, isophthalic resins and chlorendic resins. As isophthalic resins, mixtures of isophthalic acid with maleic anhydride or fumaric acid may in particular be mentioned. As chlorendic resins, mixtures of chlorendic anhydride or acid with maleic anhydride or fumaric acid may in particular be mentioned.

The protective panel 5 according to FIG. 1 is for example manufactured by thermoforming. It is transparent for infrared beams. This property allows to fix the cover relatively far from the heating body.

Figure 2:
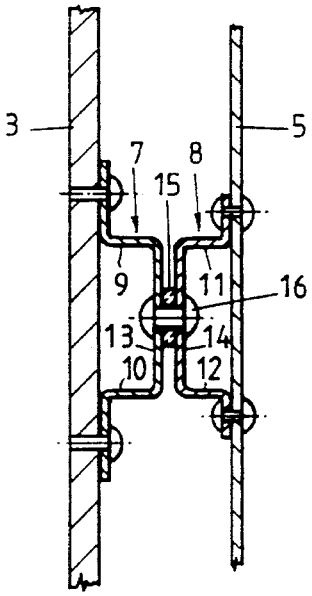
FIGS. 2, 3 and 4 show two variant devices for fixing a cover according to the invention onto a heating body.
Figure 3:
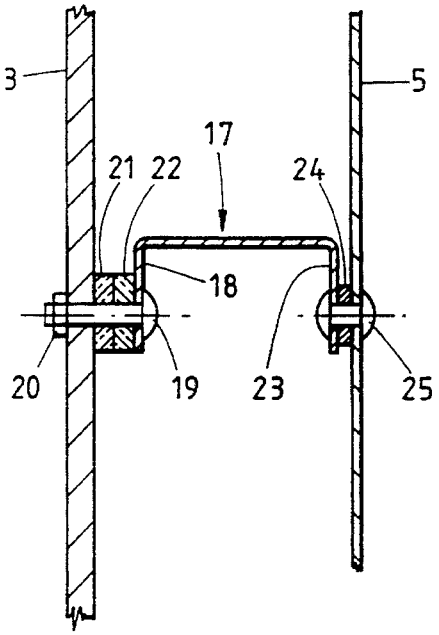

Two possible ways of fixing the panel 5 onto the heating body 3 are illustrated in FIGS. 2 and 3. The attachment elements 6 are arranged in the space between the heating body 3 and the covering panel 5. In FIG. 2, the attachment element consists of two U-shaped braces 7 and 8. The lateral arms 9, 10 and 11, 12 of each of these braces are connected to the body 3 or respectively to the panel 5, for example by means of rivets or by any other appropriate means. The webs 13 and 14 of the two braces are arranged one in front of the other and maintained on a distance from each other by a spacing element 15 from a heat insulating material, for example from porcelain. A clamping element 16, which is preferably also made of a heat insulating material, keeps the spacing element 15 secured between the two braces 7 and 8.

In FIG. 3, the attachment elements 6 are composed of a short U-shaped metal profile 17. One of its arms 18 is maintained at a distance from the heating body through washers 21 and 22 from a heat insulating material, for example from porcelain, and it is clamped against these washers by a bolt 19 going through these washers and through an opening in the heating body, and by a nut 20 arranged within the heating body 3. The other arm 23 of the profile 17 is maintained at a distance from panel 5 by a washer 24 from an insulating material, for example from cork. This entity of arm 23, washer 24 and panel 5 is rivetted in a usual way by means of a rivet 25.

Figure 4:
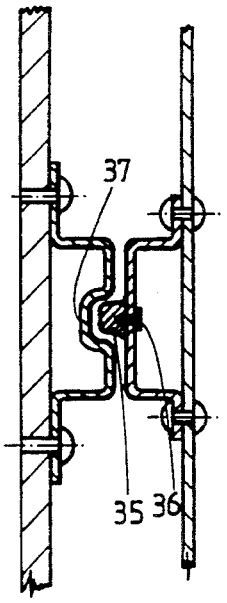

Another way of fixing the panel 5 onto the heating body 3 is illustrated in FIG. 4. This way of fixing is similar to the one illustrated in FIG. 2 but easy to remove. In this embodiment, the rivet 16 is replaced by a magnet 35 fixed to one of the braces, for example to brace 8 by an attachment element 36. In the fixed position, this magnet 35 is for example housed in a metal recess 37 of brace 7. This removable way of fixing is especially feasible according to the invention thanks to the low weight of the panel according to the invention.

Of course, other ways of fixing the cover onto the heating body can be provided.

The cover might also be rendered self-supporting. In this case, the panel 5 rests, as indicated chain-dotted in FIG. 1, with one of its edges 27 directly onto the ground. It is then advisable to use a polymeric material reinforced with fibres, for example with glass fibres, so that the panel is composed of a composite material.

Figure 5:
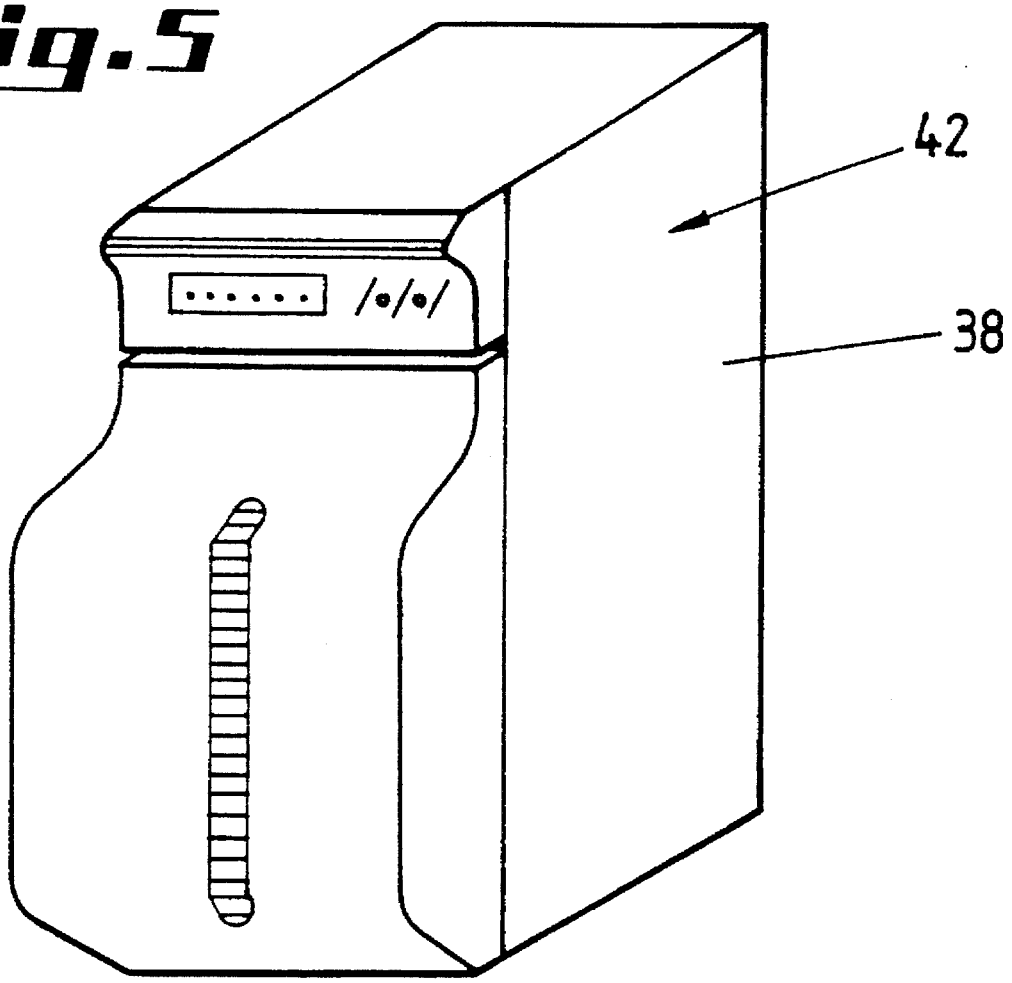
FIG. 5 shows a perspective view of a central heating boiler whose walls are covered according to the invention.

In FIG. 5 can be seen a hot water boiler 42 covered with a wall 38 made according to the invention.

It has to be understood that the present invention is in no way limited to the hereabove described embodiments and that many modifications can be applied thereto without leaving the scope of the present patent.

The covering panels according to the invention can for example by manufactured in different ways by using for example a liquid crystal polymer.

Such a lyotropic polymer, such as Kevlar, can be atomized, in solution, into two Teflon-coated dies rotating around their axis and the solvent can be evaporated. The polymer is formed against the wall of revolution as a result of the centrifugal force and the evaporation of the solvent.

It is also possible to spray a thermotropic polymeric powder, such as Rhodester CL, within the two aforesaid rotating dies heated to the required temperature for obtaining an adequate orientation of the liquid crystals (about 302° C. for Rhodester CL).

A spray process under rotation onto the die with an adhesion resulting from an electrostatic charge may also be appropriate.

Finally, in order to produce a composite material, different successive spraying steps can be provided, for example in the following order :

a) spraying of a coloured coating of short fibres or grains (thickness 1/10 mm), b) spraying mineral Wollastonite fibres in bulk or short polyethylene fibres simultaneously with a polyester resin according to the invention (thickness 1 mm), c) spraying an expansible resin of the polyurethane+ fibres type (insulator) (thickness 5 to 8 cm), d) spraying Kevlar or carbon fibres together with a resin of the alimentary type (about 6 mm).

Afterwards, the obtained product may possibly be cut into different panels destined as cover for heating bodies.

We claim:

1. A cover for a heating body comprising a thin wall at least partially screening the heating body from a region outside of the heating body, the thin wall comprising a polymeric material which is substantially rigid and which substantially resists permanent deformation at temperatures from 100° C. to 130° C., the polymeric material further substantially resisting infrared absorption at wavelengths corresponding to black-body temperatures from 200° C. to 500° C.

2. The cover as claimed in claim 1, wherein the polymeric material is substantially rigid and substantially resists permanent deformation at a temperature above 130° C.

3. The cover as claimed in claim 1, wherein the polymeric material is a polyester resin.

4. The cover as claimed in claim 3, wherein the polyester resin is selected from the group comprising bisphenol A fumarates, isophthalic resins and chlorendic resins.

5. The cover as claimed in claim 1, wherein the polymeric material is an oriented crystal polymer.

6. The cover as claimed in claim 1, wherein the thin wall is made from a composite material containing said polymeric material.

7. The cover as claimed in claim 6, wherein the composite material is composed of a fibre-reinforced polymer.

8. The cover as claimed in claim 7, wherein the fibre-reinforced polymer includes reinforcing fibres selected from the group consisting of glass fibres, carbon fibres and liquid crystal polymer fibres.

9. The cover as claimed in claim 6, wherein the composite material is composed of at least one layer of the polymeric material and of at least one layer of a supporting material supporting the layer of the polymeric material.

10. The cover as claimed in claim 1, wherein the thin wall includes a protective panel placed in front of a heating body in a self-supporting way.

11. The cover as claimed in claim 1, wherein the thin wall includes a protective panel which is fixed to a front region of the heating body and which is thermally insulated therefrom.

12. The cover as claimed in claim 1, wherein the thin wall is moulded.

13. The cover as claimed in claim 1, wherein the polymeric material of said wall is mass-stained with a coloring agent.

14. The cover as claimed in claim 1, wherein the polymeric material is substantially rigid and substantially resists permanent deformation at a temperature above 200° C.

15. The cover as claimed in claim 9, wherein the polymeric material is fibre-reinforced.

16. The cover as claimed in claim 12, wherein the thin wall is thermoformed.

17. The cover as claimed in claim 1, wherein the polymeric material is substantially rigid and substantially resists permanent deformation at temperatures from 100° C. to 350° C.

18. The cover as claimed in claim 1, wherein the thin wall has a continuous surface.

* * * * *